US005342998A

United States Patent [19]

Nolte et al.

[11] Patent Number: 5,342,998

[45] Date of Patent: Aug. 30, 1994

[54] TERMINAL BUSHING FOR ELECTRICAL APPARATUS COMPRISING A POLYMERIC SHELL MOLDED ABOUT A CENTRAL CONDUCTOR

[75] Inventors: Michael G. Nolte, Hickory; Gary D. Davis, Taylorsville; Ronny D. Jergenson, Hickory; Robert W. Scheu, Newton; Timothy G. Tillery, Hickory, all of N.C.

[73] Assignee: General Electric Company, Schenectady, N.Y.

[21] Appl. No.: 862,449

[22] Filed: Apr. 2, 1992

[51] Int. Cl.[5] ..... H01B 17/26

[52] U.S. Cl. ..... 174/152 R; 174/142; 174/153 R

[58] Field of Search ..... 174/152 R, 168, 169, 174/167, 191, DIG. 10, 166 R, 18, 80, 142, 153 R

[56] References Cited

U.S. PATENT DOCUMENTS

| | | | |
|---|---|---|---|
| 2,579,973 | 12/1951 | Schlosser | 439/519 |
| 3,097,346 | 7/1963 | Horelick et al. | 174/152 R X |
| 3,222,625 | 12/1965 | Ledocq | 174/152 R X |
| 3,422,392 | 1/1969 | Woods | 174/152 R X |
| 3,617,616 | 11/1971 | O'Loughlin | 174/94 |
| 3,708,612 | 1/1973 | Saxon et al. | 174/142 |
| 4,112,043 | 9/1978 | Williams | 174/152 R X |
| 4,767,351 | 8/1988 | Patel et al. | 174/152 R X |
| 4,791,247 | 12/1988 | Cacalloro et al. | 174/152 R |
| 4,956,525 | 9/1990 | Wilk | 174/152 R |

FOREIGN PATENT DOCUMENTS

| | | | |
|---|---|---|---|
| 0167439 | 4/1954 | Australia | 174/153 R |
| 0815853 | 7/1959 | United Kingdom | 174/152 R |

*Primary Examiner*—Leo P. Picard
*Assistant Examiner*—H. Sough
*Attorney, Agent, or Firm*—William Freedman

[57] ABSTRACT

A terminal bushing which has (a) an elongated central conductor made by a powder metallurgy process from metal particles sintered together at elevated temperatures after being compacted under pressure and (b) a tubular shell of polymeric insulating material molded under high within a mold pressure about the central conductor and forming a joint with the central conductor that has a high resistance to leakage along the conductor. The central conductor includes at opposite ends of the molded tubular insulating shell mold-interface regions that are formed by the powder metallurgy process and are located to interface with and to fit tightly within the mold that is used for molding the insulating shell, thereby limiting to low values the quantity of pressurized polymer ejected about the mold-interface regions during the molding.

9 Claims, 4 Drawing Sheets

TERMINAL BUSHING FOR ELECTRICAL APPARATUS COMPRISING A POLYMERIC SHELL MOLDED ABOUT A CENTRAL CONDUCTOR

TECHNICAL FIELD

This invention relates to a terminal bushing for electrical apparatus and, more particularly, relates to a terminal bushing of the type that comprises a central conductor and a tubular shell of polymeric insulating material molded about the central conductor.

BACKGROUND

In manufacturing a terminal bushing of the above type, a mold is provided that surrounds the central conductor and forms about the central conductor a mold cavity that has pinch points at the ends of the mold cavity where the mold and the central conductor interface. Liquid polymer under high pressures is forced into the mold cavity to fill it and is subsequently cooled to solidify the polymer and form a molded shell conforming to the shape of the mold cavity. It is important that this molded shell be free of voids that could cause corona or fluid leakage problems in the finished product, i.e., the terminal bushing. In order to obtain the desired freedom from such voids, it is important that the above-described pinch points at the ends of the mold cavity be highly restricted so as to limit to a very low value the amount of pressurized liquid polymer that is ejected from the mold via the pinch points during the molding process.

In order to produce the desired high restriction at the pinch points of the mold, it is important that the outer dimensions of the central conductor closely match the internal dimensions of the mold at the pinch points. One way of achieving the desired close match is to provide a central conductor that initially is slightly oversized at the pinch points and to then carefully machine the conductor at the pinch points to the precise size desired. This approach has the disadvantage of being unduly expensive, labor-intensive, and time-consuming.

An object of our invention is to construct the molded-shell bushing in such a way that there is no need to machine the central conductor in order to limit to a very low value the amount of liquid polymer ejected from the mold at its pinch points during the molding operation.

Another object is to provide a terminal bushing that comprises a polymeric insulating shell molded about a central conductor that is characterized by an insulating shell that is essentially free of voids that could cause corona or fluid leakage problems in the bushing.

In many terminal bushings at the outer end of the central conductor there is coupling structure that is used for connecting an external conductor to the central conductor. This coupling structure sometimes takes the form of a clamp including a basket or a blade against which the external conductor is bolted. The basket or the blade must be joined to the central conductor, and this usually results in a multi-part structure that is relatively expensive to fabricate.

Another object of our invention is construct the bushing in such a way that the central conductor and the above described basket or blade can be produced as a single unitary part that contains no joints requiring assembly.

The terminal bushing is a component of electrical apparatus and extends through an opening in a wall of the apparatus. The polymer insulating shell of the bushing has an external thread on its outer surface that meshes with a sheet metal nut that is tightened on the shell to press against the wall and thereby to hold the bushing securely in place within the wall opening.

Another object of our invention is to provide for this bushing mounting application a sheet-metal nut that has a strong resistance to loosening in response to vibrations and the like and which has a reduced tendency to damage the external threads on the bushing shell when tightened to press against the wall on which the bushing is mounted.

SUMMARY

In carrying out the invention on one form, we use for constructing the central conductor of a molded-shell terminal bushing a powder metallurgy process in which powder metal particles are first compacted under high pressure and are then sintered together at elevated temperature. Use of this powder metallurgy process enables us to obtain precise and predetermined external dimensions for the central conductor at the above-described pinch points without requiring any secondary machining of the exterior of the central conductor at such locations. We can therefore mold the polymeric shell about our central conductor without necessitating any such machining prior to the molding operation and without allowing excessive ejection of pressurized liquid polymer via the pinch points of the mold during the molding process.

We use the above-described powder metallurgy process not only for forming the central conductor but also for forming the basket or blade structure that is provided at the outer end of the central conductor. More specifically, we utilize the powder metallurgy process for forming the central conductor and the basket or blade all in one unitary piece, thus eliminating the need for any joints between these parts that require assembly and introduce energy losses.

BRIEF DESCRIPTION OF FIGURES

For a better understanding of the invention, reference may be had to the following detailed description taken in connection with the accompanying drawings, wherein.

DETAILED DESCRIPTION OF EMBODIMENTS THE EMBODIMENT OF FIGS. 1-6 AND 8-10

Figure 1:
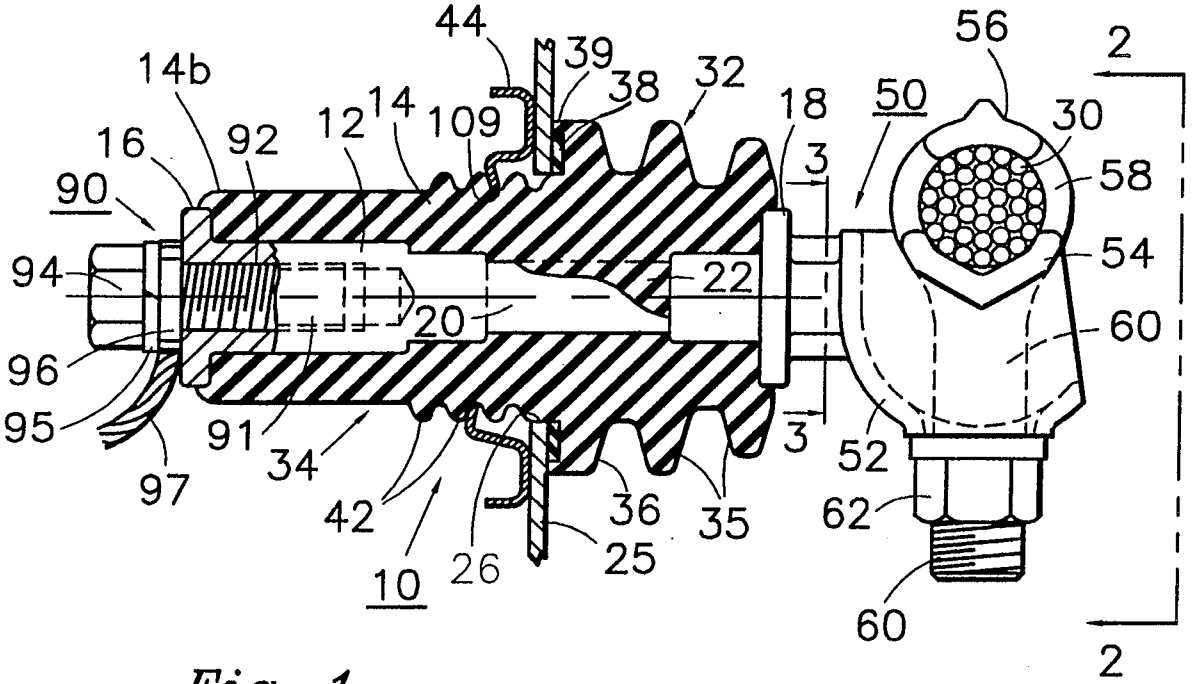
FIG. 1 is a side elevational view mostly in section of a terminal bushing embodying one form of the invention.

Referring now to FIG. 1, the terminal bushing 10 shown therein comprises an elongated central conductor 12 and a tubular shell 14 of polymeric insulating material that is molded about the central conductor. The central conductor includes at its opposite ends flanges 16 and 18 between which the molded shell 14 extends. In one form of the invention, the shell 14 is of a thermosetting polyester material; and between the shell and the central conductor is a thin film-like layer of adhesive material, preferably an epoxy bonding agent that forms a high-quality leakproof bond between the polyester shell and the central conductor. This combination of materials and certain features of the molding process are disclosed and claimed in U.S. Pat. No. 4,791,247-Cacalloro and St. Jacques, assigned to the assignee of the present invention, which patent is incorporated by reference herein.

The central conductor 12 has a flattened intermediate region 20 through which extends a rectangular opening 22. During the molding process, the polymeric material of the shell 14 fills this opening 22 and, upon hardening and curing, mechanically interlocks via opening 22 with the central conductor and forms a mechanically-strong connection between the central conductor and the shell that precludes any relative motion between these parts and provides additional protection for the bond between these parts.

The terminal bushing 10 is a component of electrical apparatus comprising a wall 25 containing an opening 26 through which the bushing extends. The bushing serves to carry current between internal components (not shown) of the electrical apparatus (which components are located to the left of the wall 25 as viewed in FIG. 1) and an external circuit comprising a cable shown at 30 in FIG. 1. The wall 25 is normally at ground potential and the central conductor 12 is normally at an elevated voltage with respect to ground. The insulating shell 14, which surrounds the central conductor 12, serves to support the central conductor on the wall 25 and also to electrically insulate the central conductor from the wall.

The insulating shell 14 comprises a first section 32 at its right-hand end which is located externally of the electrical apparatus and a second section 34 at its left-hand end which is located internally of the electrical apparatus. The externally-located section 32 has a plurality of annular petticoats 35 on its external surface serving in a conventional manner to impart improved electrical tracking resistance to the bushing in this region. The externally-located section 32 of the bushing also includes an integral mounting flange 36, which is located adjacent the wall 25. This mounting flange 36 includes in its surface facing the wall 25 an annular groove 38 in which there is located a resilient gasket 39 that provides a good seal between the flange 36 and the wall 25.

The internally-located section 34 of the bushing has an integrally-formed helical thread 42 on its external surface that receives an internally-threaded sheet-metal nut 44 (soon to be described in more detail). When this nut is tightened on the thread 42, the right-hand end face of the nut presses against the wall 25, thereby clamping the wall 25 between the nut and the mounting flange 36 and thus holding the bushing securely in place within the opening 26 in wall 25. This clamping action compresses the gasket 39 and thus maintains a good seal between the mounting flange 36 and the wall 25.

Figure 3:
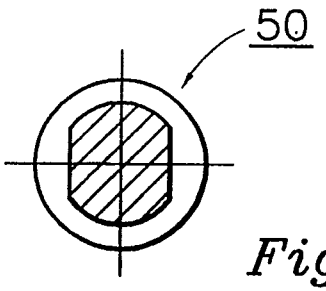
FIG. 3 is a sectional view taken along the line 3—3 of FIG. 1.
Figure 2:
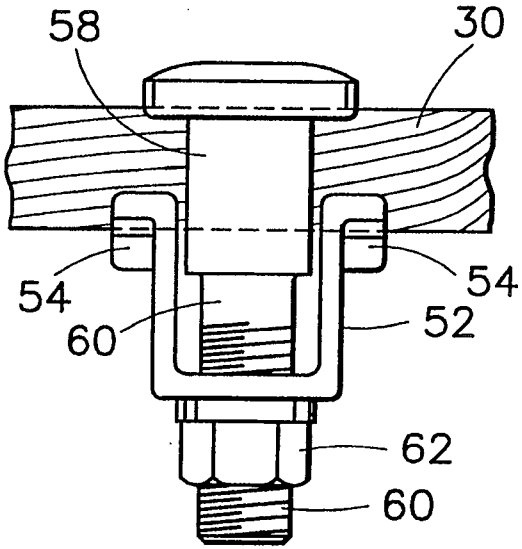
FIG. 2 is an end view of the bushing of FIG. 1 looking in the direction of the arrows 2—2 of FIG. 1.

For connecting the central conductor 12 to the externally-located cable 30, we provide clamping structure 50 at the outer end of the central conductor. The clamping structure 50 illustrated in FIGS. 1 and 3 comprises a hollowed-out basket 52 forming a cradle 54 on its upper surface for receiving the cable 30. An eye bolt 56 holds the cable against the cradle. This eye bolt comprises a sleeve 58 that surrounds the cable and a threaded shank 60 integral therewith that projects downwardly from the sleeve 58 and extends through an opening in the lower wall of the basket. On the lower end of the threaded shank there is a nut 62 that when tightened forces the sleeve 58 downwardly, thereby clamping the cable against the cradle 54. The basket 52 is of a conventional, but rather complex, configuration and has traditionally been made as a separate casting joined to the central conductor through a gasketed threaded joint. One of our objects is to eliminate the need for such a joint, and, to this end, we make the basket 52 integral with the central conductor by means of the powder metal process that will soon be described. An additional advantage of this integral formation is the improved conductivity between the central conductor 12 and the clamping structure 50 as compared to that available when a discrete joint is present between these parts.

In one embodiment of the invention, the electrical apparatus is a distribution transformer that contains a dielectric liquid such as oil having a normal level located above the bushing 10. The compressed gasket 39 provides a seal about the bushing that prevents any of this oil from leaking through opening 26 to the exterior of the transformer. In addition, the film-like layer of epoxy bonding material between the polyester body and the central conductor 12 provides a leak- proof seal between these parts that prevents oil from leaking along this interface to the exterior of the transformer.

Molding the Polymeric Shell

Figure 5:
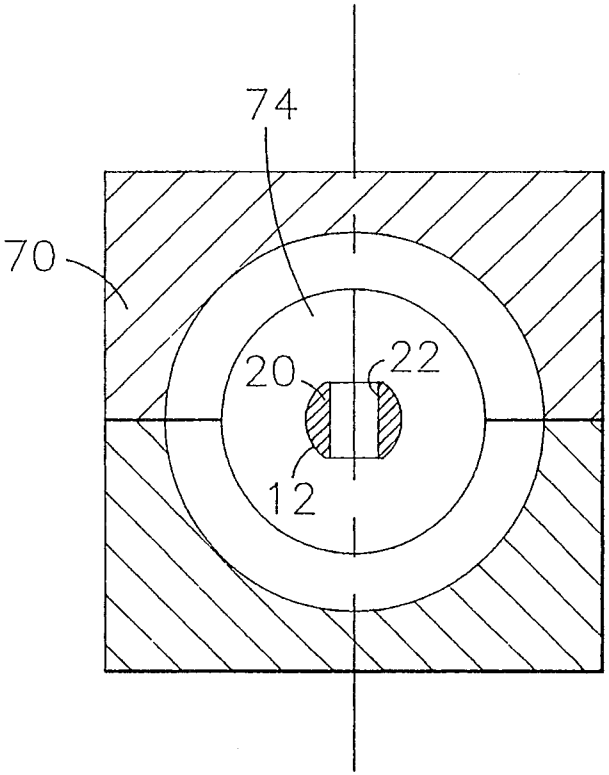
FIG. 5 is a sectional view taken along the line 5—5 of FIG. 4.
Figure 4:
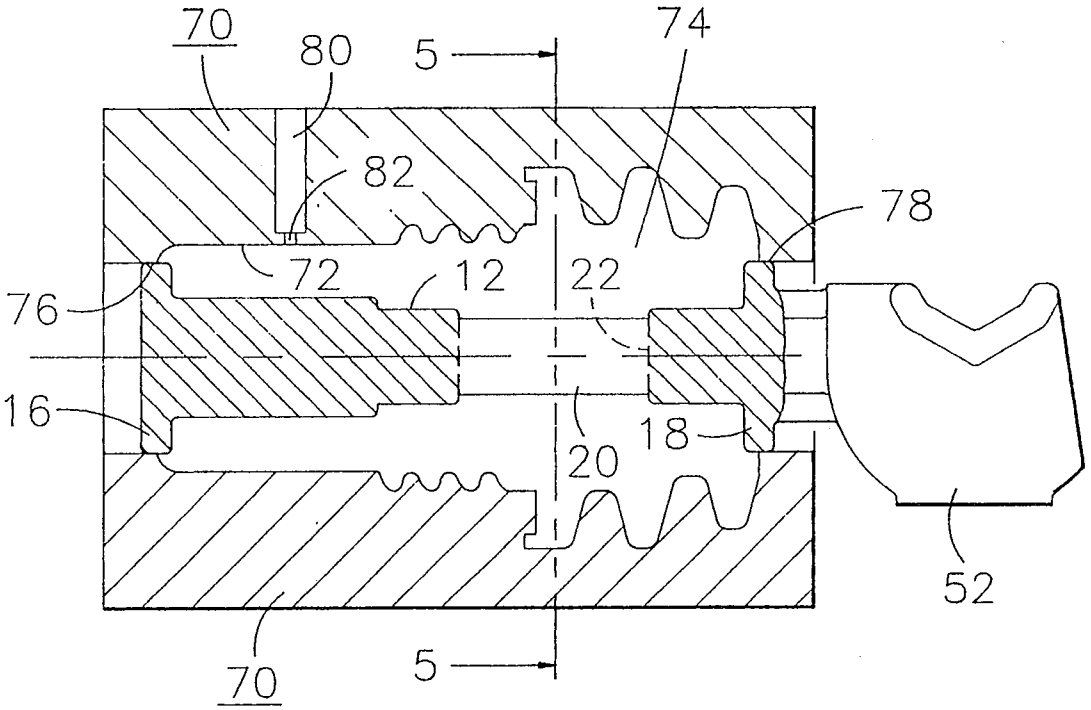
FIG. 4 is a sectional view of molding apparatus used in manufacturing the terminal bushing of FIGS. 1–3, and, more particularly, used for incorporating the molded insulating shell of the terminal bushing.

The molding process for incorporating the insulating shell utilizes a releasably held-together two-part metal mold 70 shown in FIGS. 4 and 5. This mold has a bore 72 that during the molding process surrounds the central conductor 12 in spaced relationship along most of the mold length, thereby providing a mold cavity 74 about the central conductor. The mold cavity has external dimensions that correspond to the desired external dimensions of the insulating shell. At its opposite ends the mold cavity 74 has two pinch points 76 and 78 (FIG. 4) where the mold and the central conductor interface. At each of these pinch points the mold closely surrounds the flange 16 or 18 formed on the central conductor. The insulating shell 14 is formed by injecting highly pressurized liquid polymer into the mold cavity 74 via an input passage 80 containing a gate 82. This liquid polymer quickly fills the mold cavity and builds up a high pressure-differential across the pinch points 76 and 78. Unless the small clearance spaces at the pinch points are highly restricted, an excessive amount of the liquid polymer will be ejected therethrough; and this could cause objectionable voids to develop in the finished molded product when the polymer later solidifies and cures within the mold cavity 74. Such voids could produce corona and fluid leakage problems in the finished bushing when placed in service.

To limit the amount of liquid polymer ejected via the pinch points, the clearances, if any, present in these locations must be highly restricted. As pointed out herein above, one way of achieving such high restrictions is to carefully machine the exterior of the flanges 16 and 18 to provide a close match with the interior dimensions of the juxtaposed portions of the surrounding mold. But this approach is unduly expensive and time-consuming.

By forming the central conductor 12 by a powder metallurgy process, soon to be described, we are able to limit to the desired extent the amount of pressurized polymer ejected via the pinch points during the molding process without the need for first machining the exterior of the flanges 16 and 18. This powder metallurgy process yields a central conductor in which the flanges 16 and 18 are of precise predetermined external dimensions that enable them to fit sufficiently tightly within the surrounding mold so that ejection of the pressurized polymer through the pinch points is held to the desired very low value. The outer peripheries of the flanges may be thought of as mold interface regions of the central conductor.

Forming Part 12, 50 by Powder Metallurgy

The powder metallurgy process is carried out by providing a multi-part die 85 (FIG. 6) having an internal cavity 86 that has the same external configuration as the external configuration of the combined central conductor 12 and clamping structure 50 and dimensions that are slightly larger than the external dimensions of the central conductor and clamping structure. Also provided is a quantity of powder metal of the desired composition, for example, copper or brass, mixed with an appropriate solid lubricant in powder form. The internal cavity 86 is filled with the powder metal mixture, using a filling and compacting technique that involves filling and compacting different zones of the internal cavity with the powder metal mixture in discrete sequential steps. Starting with the right-hand end of the cavity 86, the region 87 of basket 52 is first filled with the powder metal mixture and then compacted. Then successive zones to the left are filled and compacted, each zone being compacted before the next is filled and compacted. Compacting is done with a press (not shown) that applies tens of tons per square inch of pressure to the powder metal mixture.

The die 85, which is diametrically split, is then opened, and the compacted body therein (i.e., the green compact) is removed, following which it is heated in a furnace containing an inert atmosphere to an appropriate temperature at which it is maintained for a long enough period to sinter the powder metal particles together into a mechanically strong body. Some minor shrinkage occurs during the sintering process, but the extent of the shrinkage is sufficiently predictable and controllable that precise and predetermined final external dimensions of the flanges 16 and 18 can be achieved. For example, for flanges having a nominal diameter of 1.000 inch, diametrical tolerances of $\pm 0.003$ inches can be achieved using the powder metallurgy process without any machining of the flange peripheries.

In the hollowed-out regions of the central conductor 12 and the basket 52, the die 80 contains appropriately-shaped metal core structure fixed to one of the die parts for excluding the powder metal mixture from the core regions during the filling and compacting process, thus providing in these regions the desired hollows in the green compact.

In compacting the powder metal within the die 85, it is important that the powder metal be compacted to substantially the same density throughout the die cavity 86. If the metal density is not substantially uniform throughout the final sintered metal part, there will be built-in stresses in the part that could unduly weaken it and compromise its ability to withstand the heavy mechanical loads to which it is sometimes subjected. The filling and compacting of the cavity in localized regions before proceeding to new regions, i.e., the sequential compacting referred to hereinabove, facilitates obtaining the desired substantially uniform density of the powder metal part. By substantially uniform density, we mean a density varying no more than about 10 percent and, preferably, substantially less. The heavy mechanical loads referred to could be developed when the cable 30 is weighted down with snow or with a fallen tree limb or is subjected to high winds, especially when so weighted down, or if a lineman applies an excessive torque to the part during installation.

A high degree of compaction of the powder metal is necessary in order to give the final sintered part the required mechanical strength to withstand heavy mechanical loads, such as those developed under the conditions described in the immediately-preceding paragraph. In addition, if there were regions where the powder metal had not been compacted to the desired high degree, the conductivity of the part would be relatively low in these regions, and this could lead to objectionable overheating.

Figure 6:
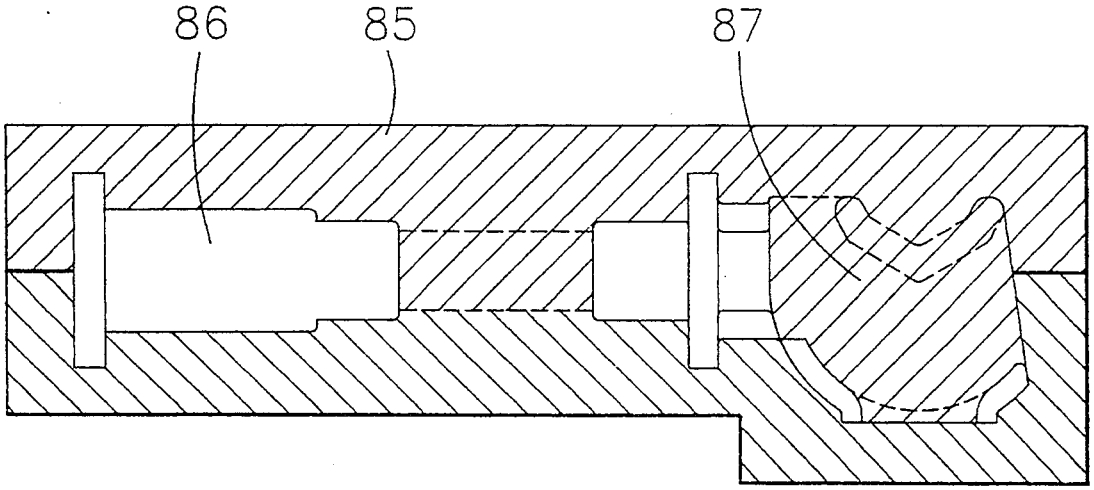
FIG. 6 is a sectional view of apparatus used for forming the central conductor of FIG. 1 by a powder metallurgy process.

It is recognized that powder metallurgy is not a new technique for forming certain metal parts, but we are unaware of its prior use for forming parts corresponding to our central conductor, especially to enable such part to be used without machining in a subsequent molding process where pinch points are present about the periphery of the part. In view of this background, the die 85 of FIG. 6 is shown in simplified form and the powder metallurgy process is described without elaborating upon details of the conventional powder metallurgy process and the apparatus used for practicing same. For example, it is understood that the two-part die 85 is clamped together with suitable releasable clamping means (not shown) to enable it to remain fully closed against the high pressures developed therein during the above-described compacting operations.

Additional Features of the Bushing

The central conductor 12 must have sufficient stiffness to resist bending forces without flexing under the high loading conditions described hereinabove. Such flexing could damage the bond between the central conductor 12 and the surrounding insulating shell 14, especially since the insulating shell, being of a hard thermosetting polymer, has no substantial ability to flex. To impart the required stiffness to the central conductor, its transverse cross-section at all points along its length is made large enough so that the conductor will not flex under maximum anticipated loads.

Another noteworthy feature of the illustrated terminal bushing is the means 90 used for electrically connecting the inner end of the central conductor 12 to the internal components of the electrical apparatus. This means 90 comprises an internally threaded hole 91 in the central conductor and an externally threaded screw 92 that extends into hole 91.

The screw 92 has a head 94, and between this head 94 and the flange 16 there is a conductive lock washer 95 and a terminal portion 96 of a lead 97 that connects the bushing to the internal components of the electrical apparatus. When the screw 92 is tightened to a specific torque, the terminal portion 96 and the lock washer are clamped between the screw head 94 and the flange 16, thus providing a good electrical connection between parts 96 and 16. The compressed lock washer prevents the screw from loosening despite vibrations and the like during shipment, installation, or operation of the bushing, thus maintaining the good electrical connection.

Figure 7:
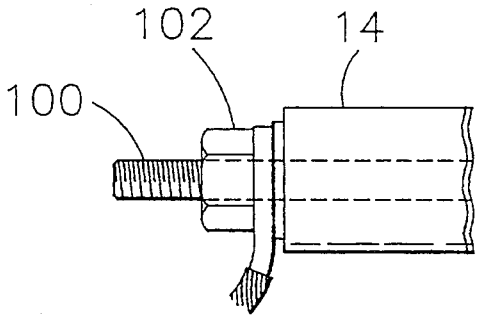
PRIOR ART Fig. 7
FIG. 7 is a side elevational view of the inner end portion of a prior art bushing.

A traditional approach for making an electrical connection between the inner end of a terminal bushing and the internal components of the apparatus is illustrated FIG. 7. As seen in this figure, this approach has involved extending the central conductor 100 of the terminal bushing for a substantial distance beyond the end of the insulating shell 14 and providing this projecting end of the central conductor with external threads and an internally threaded nut 102 that seats on the projecting end. Terminal structure such as 96 is located between this nut 102 and the end of the bushing and is sandwiched between the nut and the bushing end when the nut is tightened. Typically, a lock washer (not shown) is provided between the nut and the terminal structure 96.

An advantage of our design over this traditional design is that there is present in our design no projecting end of the central conductor. Electrical clearance space in this region is usually at a premium, and the presence of the projecting end consumes some of this scarce space, requiring that adjacent low voltage structure (not shown) be located further away from the bushing end than is the case when no projecting end is present, as with our bushing. Thus, our bushing connection 90 permits a more compact design of the electrical apparatus than is permitted with the prior art design of FIG. 7.

The Sheet-Metal Nut 44

The sheet-metal nut 44 that is used for securing the insulating shell 14 to the wall 25 of the electrical apparatus includes some special features that contribute to the high reliability of our bushing and will now be described in more detail. Referring to FIG. 1 and the enlarged views of FIGS. 8, 9, and 10, this sheet-metal nut 44 has a central passage 109 extending therethrough that surrounds the internally-located section 34 of the bushing shell 14. The nut includes a radially-extending body portion 110 and a substantially annular and helical flange portion 112 of L-shaped cross-section bordering and substantially surrounding the central passage 109. This L-shaped flange portion 112, when viewed in transverse cross-section section, as in FIG. 10, comprises two legs 114 and 116, one of which 114 extends along the length of passage 109 and the other of which 116 extends transversely of the passage 109 and is positioned between adjacent turns of the helical thread 42 on the insulating shell 14 (FIG. 1). Leg 116 has an outer surface 117 of helical form that has the same pitch as the helical thread 42 and engages a lateral surface of the helical thread. The flange portion 112 defines a single-turn helical thread that extends about the entire periphery of passage 109 except for a short distance where there is an interruption 118 between the ends of the thread. Accordingly, when the nut is fully tightened on the external thread 42 of the bushing and presses against the wall 25, the outer surface 117 of the leg 116 engages the lateral surface of the external thread 42 substantially continuously about substantially the entire periphery of the central passage 109.

The term "substantially continuously about substantially the entire periphery", as used in this application to define the engagement between a leg of the nut and the helical external thread on the polymer bushing shell denotes such continuous peripheral engagement as is effective to materially reduce thread breakage when the nut is fully tightened as compared to that occurring (a) with corresponding structure differing from that illustrated only in including a sheet metal nut that differs from the illustrated nut by having this leg divided into a series of angularly-spaced teeth for engaging the thread and (b) when such nut is fully tightened. This latter nut and its operation are described in the immediately-following paragraph.

Nuts similar to that disclosed have been used heretofore for mounting externally threaded bushings, but such nuts, instead of having a continuous flange portion 112 for engaging the external thread on the bushing shell, have had a series of angularly-spaced teeth for engaging the thread. This prior nut seemed satisfactory for porcelain-shell bushings having an external thread meshing with the nut, but when used with polymer-shell bushings having a thread meshing with the nut, an unduly large number of such bushings were experiencing broken threads when the nuts were fully tightened. We have been able to substantially reduce the number of such thread failures by employing a nut in which the internal thread extends substantially continuously around substantially the entire inner periphery of the nut and has an effective pitch matching that of the molded shell, as in our above-described design. Our studies of this matter show that this latter design distributes the clamping force much more evenly over the bushing thread than the prior design, thus reducing the chances for premature thread failure.

Figure 8:
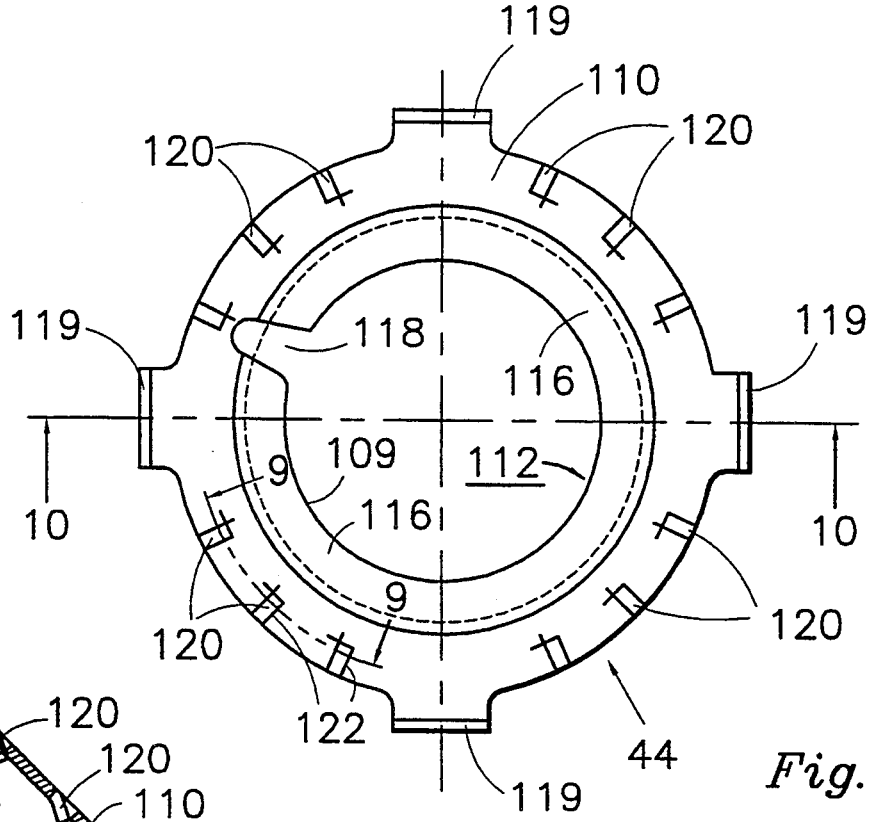
FIG. 8 is an enlarged end view of the sheet-metal nut that is used for mounting the bushing of FIG. 1 on the wall of electrical apparatus.
Figure 9:
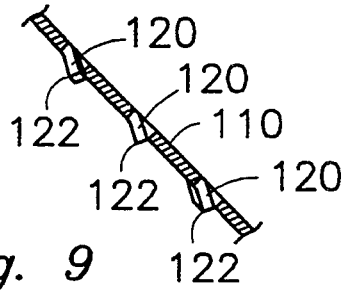
FIG. 9 is a sectional view along the line 9—9 of FIG. 8.
Figure 10:
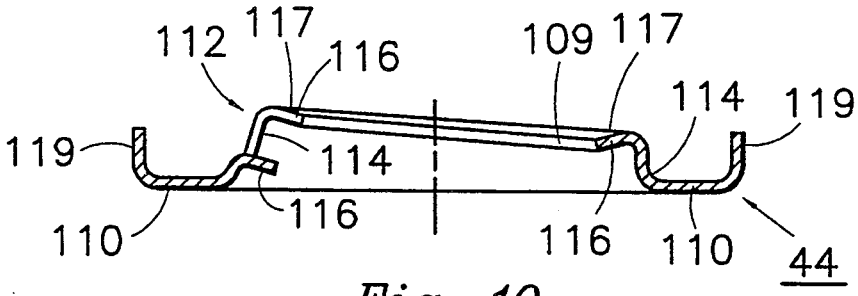
FIG. 10 is a sectional view along the line 10—10 of FIG. 8.

Another problem encountered when the above-described prior nut was used was that the nut sometimes loosened due to vibrations and other forces developed during shipment and operation of the electrical apparatus. Occasionally, glue was applied to the nut to hold it in place after it had been tightened. We have greatly reduced this tendency to loosen without the need for any such glue by providing die-cut teeth 120 in the outer peripheral region of the body portion 110 of the nut. As shown in FIGS. 8 and 9, these teeth 120 extend peripherally of the body portion and terminate in sharp edges 122 that are adapted to engage the metal wall 25 when the nut is fully tightened on the helical thread 42. These sharp edges 122 are oriented to dig into the metal wall 25 when loosening force is applied to the nut after the nut has been fully tightened, thus effectively resisting any such nut-loosening.

To facilitate tightening of the nut 44, four angularly-spaced ears 119 are provided at the outer periphery of the nut. Tightening forces can be applied through these ears to the body 110 of the nut. In one embodiment of the invention, the nut 44 is a stamping made from spring steel 0.045 inches in thickness, heat treated and hardened after the stamping operation to a hardness of Rockwell "C" 44–48.

Figure 11:
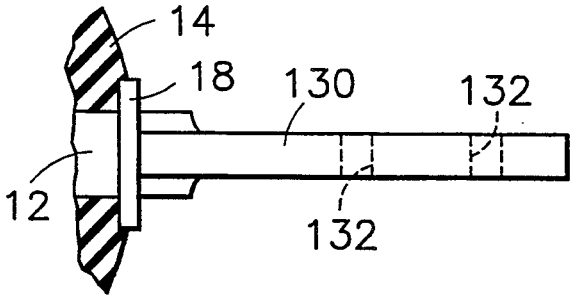
FIG. 11 is a fragmentary side elevational view, partly in section, illustrating a modified embodiment of the invention.

Additional Embodiment of FIG. 11

While we have shown a basket-type of clamping structure 50 for connecting the central conductor 12 to an external conductor (30), our invention in its broader aspects is not so limited. For example, referring to FIG. 11, this clamping structure in certain applications will be in the form of a flattened blade 130 is made by essentially the same powder metallurgy process described hereinabove. The external conductor (not shown) in this construction is simply bolted to the flattened blade, for example, by bolts (not shown) extending through holes 132 in the blade.

The Contribution of Flanges 16 and 18 to Mechanical Strength

A significant feature of our bushing not discussed hereinabove is that the presence of the end flanges 16 and 18 imparts to the insulating shell 14 mechanical strength that assists the insulating shell in withstanding the clamping forces applied by the nut 44 and other forces as well. In this regard, note that when the nut 44 is tightened, it applies to the interior section 34 of the insulating shell a force which tends to drive the inner end 140 of the bushing shell to the left as viewed in FIG. 1. But such leftward force is opposed by the inner flange 16, which transmits this force through the elongated body of the central conductor 12 to the other flange 18, tending to drive this other flange 18 to the left as viewed in FIG. 1. Leftward force applied to flange 18 loads the exterior section 32 of the bushing shell in compression. Also, between the nut 44 and the inner flange 16, the interior section 34 of the bushing shell is loaded in compression by the above-described clamping force applied by the nut 44. So the bushing shell is loaded primarily in compression by the clamping force and the central conductor is loaded primarily in tension by the clamping force. This combination of loadings enables the central conductor to reinforce the insulating shell and increases the bushing shell's ability to withstand without damage not only the clamping force but other heavy loads (e.g., cantilever loads applied to the outer end of the bushing).

While we have shown and described particular embodiments of our invention, it will be apparent to those skilled in the art that various changes and modifications may be made without departing from our invention in its broader aspects; and we, therefore, intend herein to cover all such changes and modifications as fall within the true spirit and scope of our invention.

What we claim is:

1. A terminal bushing for electrical apparatus, comprising:

(a) an elongated central conductor made by a powder metallurgy process from metal particles sintered together at elevated temperatures after being compacted under pressure, (b) a tubular shell of polymeric electrical insulating material molded under high pressure about said central conductor and forming a joint with said central conductor that has a high resistance to leakage along said conductor, and in which:

(c) the central conductor includes at opposite ends of said molded tubular insulating shell mold-interface regions that are formed by said powder metallurgy process and are located to be adapted to interface with and to fit tightly within a mold used for molding said insulating shell, (d) said central conductor at opposite ends of said molded tubular insulating shell further comprises flanges having outer peripheries that constitute said mold-interface regions.

2. A bushing as defined in claim 1 in which:

(a) said central conductor has an inner end for location within said electrical apparatus, an outer end, and a longitudinal axis extending between said ends, (b) there is provided in said inner end of said central conductor a hole having a threaded portion extending along said longitudinal axis, and (c) a screw extends into said hole and has a threaded portion mating with the threaded portion of said hole, said screw also having a head at the outer end of the screw for clamping to the inner end of said central conductor a lead that is adapted to be sandwiched between said screw head and said inner end of the central conductor when the screw is tightened within said hole.

3. A bushing as defined in claim 1 in which:

(a) said elongated central conductor has a hole therein extending transversely of the length of the conductor, and (b) said polymeric insulating material fills said hole and interlocks the shell with respect to said central conductor to preclude relative motion between the shell and the central conductor.

4. A terminal bushing as defined in claim 1 and further characterized by said powder-metal central conductor having a substantially uniform density throughout.

5. A terminal bushing as defined in claim 1 and further comprising:

(a) conductive structure at the outer end of said central conductor for interconnecting said central conductor with an external circuit conductor that is adapted to be fastened to said conductive structure, and in which:

(b) said conductive structure is made by a powder metallurgy process from metal particles sintered together at elevated temperatures after being compacted under pressure, and (c) said central conductor and said conductive structure are formed as a single unitary part during the powder metallurgy process used for forming said central conductor and said conductive structure.

6. A terminal bushing as defined in claim 5 and further characterized by said single unitary part having a substantially uniform density throughout.

7. A terminal bushing that is adapted to extend through an opening in a wall of electrical apparatus, comprising:

(a) an elongated central conductor, (b) a tubular shell of insulating material surrounding said central conductor and joined thereto, said shell comprising a first section at one end of the shell that is adapted to be located on the exterior side of said wall and a second section at an opposite end of the shell that is adapted to be located on the interior side of said wall, said second section having on its outer periphery an integrally-formed helical thread, the thread having two lateral surfaces and an outer peripheral surface located between said two lateral surfaces, and (c) a sheet-metal nut that has a passage extending therethrough surrounding said second section of the shell, said nut including a radially-extending annular body portion surrounding said passage and an annular flange portion of L-shaped cross-section at the inner periphery of said body portion, said L-shaped flange portion comprising two legs of annular form surrounding said passage, one of said legs extending along the length of said passage and the other leg extending transversely of said passage and positioned between adjacent turns of said helical thread, said other leg having an outer surface of helical form having the same pitch as said helical thread and engaging a lateral surface of said helical thread continuously about the entire periphery of said passage when said nut is tightened on said helical thread to force said body portion against said wall, and (d) said engagement extending continuously around the periphery of said passage from a first terminal point on said periphery to a second terminal point on said periphery located angularly closely-adjacent said first terminal point.

8. A terminal bushing that is adapted to extend through an opening in a wall of electrical apparatus, comprising:

(a) an elongated central conductor, (b) a tubular shell of insulating material surrounding said central conductor and joined thereto, said shell comprising a first section at one end of the shell that is adapted to be located on the exterior side of said wall and a second section at an opposite end of the shell that is adapted to be located on the interior side of said wall, said second section having on its outer periphery an integrally-formed helical thread, the thread having two lateral surfaces and an outer peripheral surface located between said two lateral surfaces, and (c) a sheet-metal nut that has a passage extending therethrough surrounding said second section of the shell, said nut including a generally radially-extending annular body portion surrounding said passage and a substantially annular flange portion of L-shaped cross-section at the inner periphery of said body portion, said L-shaped flange portion comprising two legs of substantially annular form substantially surrounding said passage, one of said legs extending along the length of said passage and the other leg extending transversely of said passage and positioned between adjacent turns of said helical thread, said other leg having an outer surface of helical form having the same pitch as said helical thread and engaging a lateral surface of said helical thread substantially continuously about substantially the entire periphery of said passage when said nut is tightened on said helical thread to force said body portion against said wall, and in which:

(d) said body portion of said nut contains integral teeth angularly spaced about said body portion, said teeth extending peripherally of said body portion and terminating in sharp edges that are adapted to engage said wall when said nut is tightened on said helical thread, said sharp edges being oriented to dig into said wall when loosening force is applied to said nut after the nut has been tightened to produce engagement of said sharp edges with said wall, thereby resisting such nut-loosening.

9. The bushing of claim 8 in which said integral teeth are located adjacent the outer periphery of said body portion.

* * * * *